US005746539A

United States Patent [19]

Mara

[11] Patent Number: 5,746,539

[45] Date of Patent: May 5, 1998

[54] RAPID ROAD REPAIR VEHICLE

[75] Inventor: Leo M. Mara, Livermore, Calif.

[73] Assignee: Sandia National Laboratories, Livermore, Calif.

[21] Appl. No.: 496,274

[22] Filed: Jun. 28, 1995

[51] Int. Cl.[6] ..... E01C 19/18; E01C 23/07

[52] U.S. Cl. ..... 404/84.05; 404/102; 404/111

[58] Field of Search ..... 404/72, 75, 84.05, 404/84.1, 84.5, 101, 104, 108, 111, 102

[56] References Cited

U.S. PATENT DOCUMENTS

| | | | |
|---|---|---|---|
| 4,473,319 | 9/1984 | Spangler | 404/84.05 X |
| 5,294,210 | 3/1994 | Lemelson | 404/84.1 |
| 5,364,205 | 11/1994 | Lemelson | 404/72 |
| 5,549,412 | 8/1996 | Malone | 404/84.1 |
| 5,584,597 | 12/1996 | Lemelson | 404/111 X |

*Primary Examiner*—James Lisehora
*Attorney, Agent, or Firm*—Bruce M. Winchell

[57] ABSTRACT

Disclosed is a rapid road repair vehicle capable of moving over a surface to be repaired at near normal posted traffic speeds to scan for and find an the high rate of speed, imperfections in the pavement surface, prepare the surface imperfection for repair by air pressure and vacuum cleaning, applying a correct amount of the correct patching material to effect the repair, smooth the resulting repaired surface, and catalog the location and quality of the repairs for maintenance records of the road surface. The rapid road repair vehicle can repair surface imperfections at lower cost, improved quality, at a higher rate of speed than was was heretofor possible, with significantly reduced exposure to safety and health hazards associated with this kind of road repair activities in the past.

8 Claims, 1 Drawing Sheet

RAPID ROAD REPAIR VEHICLE

GOVERNMENT INTEREST

This invention was made with Government support under Contract No. DE-AC04-94AL85000 awarded by the U.S. Department of Energy to Sandia Corporation for the management and operation of the Sandia National Laboratories. The Government has certain rights in the invention.

FIELD OF THE INVENTION

The present invention relates to a rapid road repair vehicle which analyzes and repairs surface imperfections as the rapid road repair vehicle is moving over the surface being repaired. It is motor-driven and uses very rapidly setting patching materials which can be applied by the vehicle after sensors analyze the problems and a solution is transmitted to the nozzles dispensing various rapid setting patching materials to the surface site to be repaired.

BACKGROUND OF THE INVENTION

Potholes and other road problems associated with road surface imperfections are encountered very often on highways and other paved surfaces such as airport runways or parking lot areas especially where there is a heavy traffic pattern over the surface by heavy vehicles. The conventional methods for repairing these road surfaces require a significant amount of labor intensive activity to repair these surfaces and even then the repairs are many times of questionable quality and questionable durability. This process is time consuming and poses a significant impediment to traffic flows which are very costly in terms of delay and safety hazards. Typically, one or more workers walk along the road surface to observe road surface problems and direct the driver of a vehicle to position the dispenser on a truck over the problem area in the road surface to dispense material which is many times tamped into place by hand. Other problems can be filled with shovel fulls of material which are then tamped into place by hand. This labor intensive process is expensive in terms of time expended and the number of times the process must be repeated to finally fix the surface sufficiently to accommodate the traffic pattern. This process is also a problem in that many repair people are exposed to potentially harmful chemical substances.

U.S. Pat. Nos. 5,294,210 and 5,364,205 describe a method and an apparatus for automated pothole sensing and filling having a starting level of automation to handle the finding and filling of potholes. This equipment is limited to finding and filling larger holes which may involve only large translation of sensors and outlets for filling materials. It would only be suitable for dispensing molten asphalt or similar materials which would require considerable set and cure times. This would also require stopping the vehicle to accomplish the task in an efficient way and sectioning off whole segments of the highway to keep vehicles from getting into the repairs too soon. This would slow traffic patterns to an extent that there would be little value added with the use of such equipment which may explain why it has not been adopted for large scale use.

SUMMARY OF THE INVENTION

The present invention is a rapid road repair vehicle which analyzes and repairs surface imperfections in roads as the rapid road repair vehicle is moving over the road being repaired. It is motor-driven and uses very rapidly setting road patching materials which can be applied by the vehicle after sensors analyze the problems and a solution is transmitted to the nozzles dispensing various rapid setting road patching materials to the site. The present invention includes a sophisticated array of sensors to detect the type of problem as well as measure the amount of materials needed to repair the problem. Also included are a set of road surface cleaning devices to assure a high quality repair that will not have to be repeated as often as is presently the case with such road repairs.

It is therefore a primary object of the present invention to provide a rapid road repair vehicle which will significantly enhance the quality of road repairs.

It is another object of the present invention to provide a rapid road repair vehicle which will significantly enhance the convenience of making road repairs at a significant savings.

It is a further object of the present invention to provide a rapid road repair vehicle which can easily be adapted to use with various types of highways to minimize the impact of the repairs on the traffic flow and improve the health and safety for the traveling public as well as the repair crews.

It is still another object of the present invention to provide a rapid road repair vehicle which can be operated by one person using one piece of equipment and operated at any time of the day or night which would reduce human exposure to potentially harmful chemical substances.

It is still a further object of the present invention to provide a rapid road repair vehicle that could repair roads much faster, cheaper, with higher quality, more safely, and with little or no loss of travelers's time or disruption of traffic flows.

These and other objects of the present invention, will become apparent to those skilled in this art upon reading the accompanying description, drawings, and claims set forth herein.

DESCRIPTION OF THE PREFERRED EMBODIMENT

Figure 1:
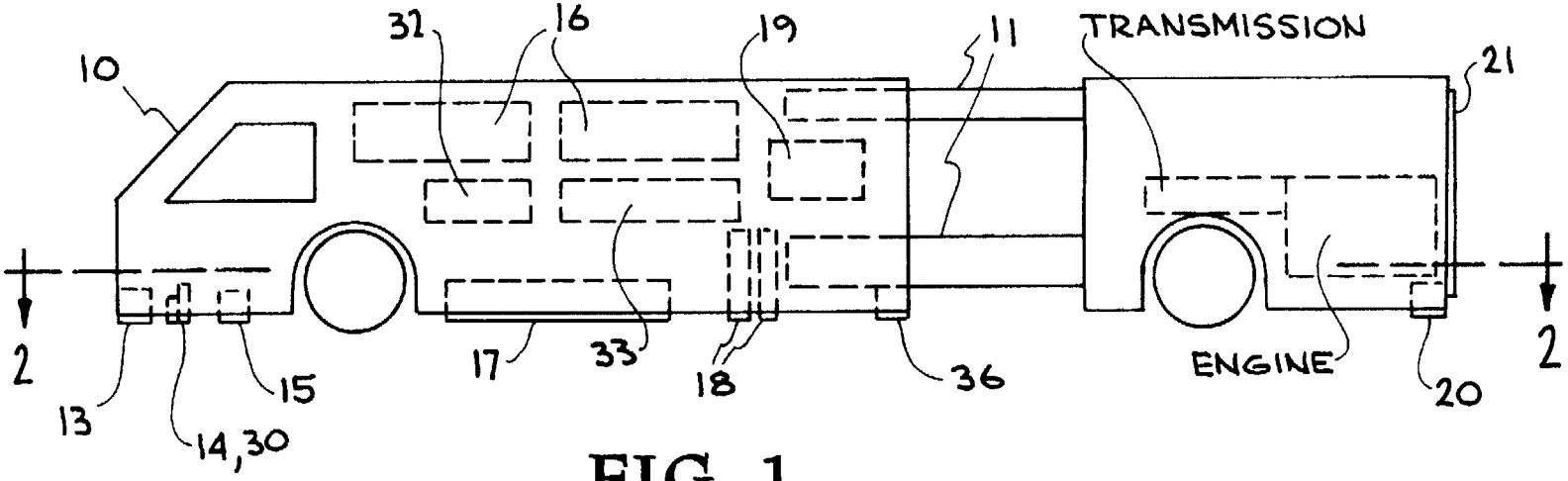
FIG. 1 is a side section view of the rapid road repair vehicle according to the present invention.
Figure 2:
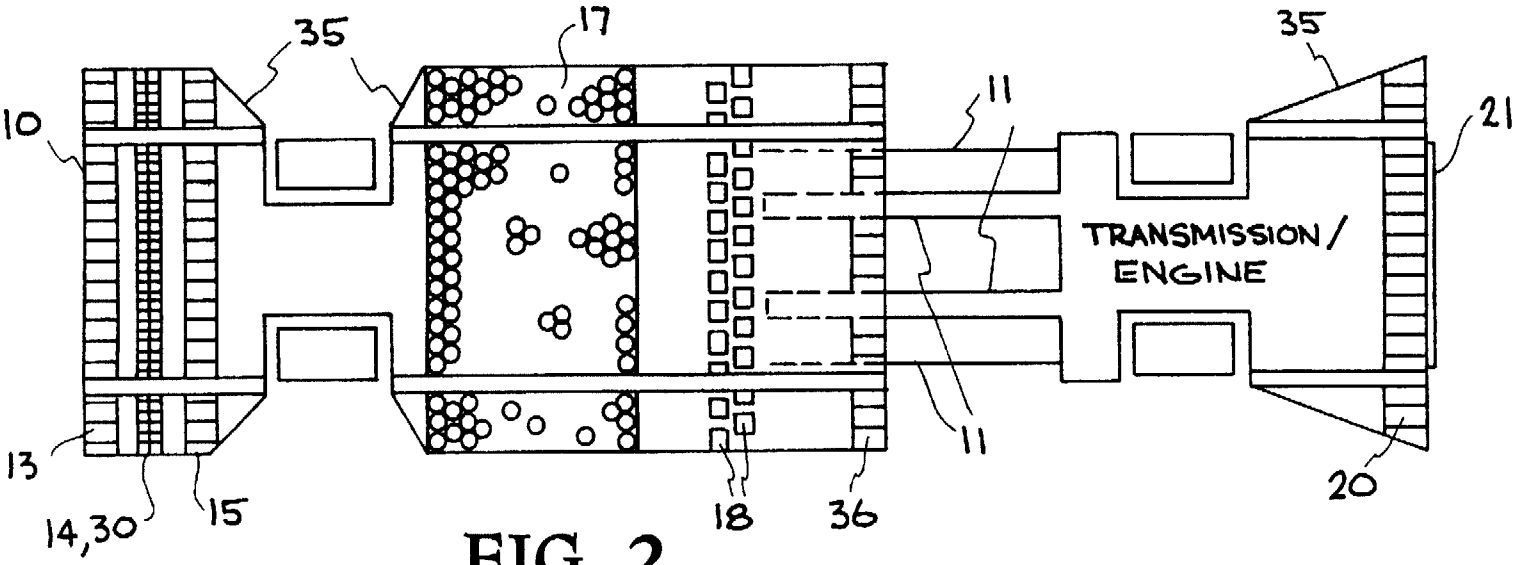
FIG. 2 is a top section view of the rapid road repair vehicle of the present invention taken along line 2—2 of FIG. 1.

FIG. 1 shows a side sectional view of the rapid road repair vehicle 10 according to the concepts of the present invention. As can be amply seen from the drawings the rapid road repair vehicle 10 is variable in length to accommodate both the curing time of repair materials and its own maneuverability by means of chassis slides 11. The rapid road repair vehicle 10 would be made shorter for self-transport and for use in places like city streets, where low speed operation would be suitable by means of the chassis slides 11 which may conveniently be hydraulic cylinders for automatic operation of the change in length of the rapid road repair vehicle 10. It can be easily lengthened by the operator for use on highways at significantly greater speeds or slower curing patching materials by use of the chassis slides 11. The added length provides the necessary time barrier to protect the road repairs from on-coming traffic at higher traffic speeds. The rapid road repair vehicle 10 can be equipped with foldable wing panels 35 as amply seen on FIG. 2 of the drawings which serve as width extensions of the scanners, dispensers, etc to accommodate wider surfaces to be repaired. This allows for easy transport of the rapid road repair vehicle 10, as well as repair of up to three road widths.

A first row of range scanners 13 are mounted in the front of the rapid road repair vehicle 10 to scan the road surface for imperfections that need to be repaired. An example of a preferred scanner for this application would be the RS 2200 Ranger high speed range scanner available from Metolius Inc., 14127 125th Ave., Kirkland, Wash. 98034. This system has a very high scanning rate so that fast moving objects can be measured with no moving laser beam and at a low cost for such high performance. This type of scanner would permit the rapid road repair vehicle to make measurements at speeds of 40 miles per hour as well as measure the volume of the cavity to calculate the amount of patching materials needed to properly repair the damaged surface. Behind the first row of scanners 13 there can be seen in the drawings a row of cleaning devices 14 and 30 to clean the surfaces to be repaired to assure good adhesion of the patching materials to be applied to the imperfection in the road surface. The row of cleaning devices 14 and 30 may include high pressure air in the leading row followed by vacuum in the trailing row to effect good quality cleaning of the surface of all loose materials as well as vacuuming these material into a debris storage area 33. Following the row of cleaning devices 14 and 30 is a second row of scanners 15. The second row of scanners 15 feed additional data to the rapid road repair vehicle 10 as to select the proper amount of materials for the repair and to position the rapid road repair vehicle 10 to perform the repairs.

The rapid road repair vehicle 10 carries tanks 16 of varying road repairing materials which would be plumbed to interwoven arrays of fast acting pneumatic dispensing nozzles 17. The interwoven arrays of fast acting pneumatic dispensing nozzles 17 are located at an appropriate distance behind the second row of scanners 15 to allow for the processing of the information necessary to activate the appropriate set of interwoven arrays of fast acting pneumatic dispensing nozzles 17. Following the interwoven arrays of fast acting pneumatic dispensing nozzles 17 are several rows of pneumatic actuated Teflon shoed road surface tampers 18 to smooth the resulting road surface and to compact the materials applied to the road surface imperfections to obtain a good road surface condition. The rapid road repair vehicle has a air compressor 19 and a vacuum pump 32 to power the associated equipment on the rapid road repair vehicle 10 in rapid response to the information collected and transmitted to the repair equipment so that the rapid road repair vehicle 10 may move at a high speed while completing repairs to at least an entire lane at one time. The final step in the rapid road repair vehicle 10 process will require a third row of scanners 20 at an appropriate distance from the interwoven arrays of fast acting pneumatic dispensing nozzles 17 to check its performance and log road conditions against time and a location for any future work if needed. This can include a Global Positioning System known as GPS in conjunction with the scanners 20 to map the precise location as well as the time and surface conditions. Mounted on the rear of the vehicle, facing traffic, is a flip dot display sign 21 warning motorist of the repair work, and to keep their distance. This flip dot display sign 21 could be used to inform approaching motorists of the rapid road repair vehicle 10 speed, or display any other information.

Complications arising from curves in the roadway, such as misalignment of scanners 13, 15 or 20 and repair equipment on the rapid road repair vehicle 10, would be addressed by monitoring changes in the rapid road repair vehicle steering angle.

The rapid road repair vehicle 10 will carry out its task in the following sequence. The first row of scanners 13 provide optical recognition of road surface damage or imperfections. A dedicated on-board processor measures and calculates the volume of affected area. Cleaning of the damaged area is facilitated with high pressure gas and/or a row of high vacuum cleaning devices 14 and 30. The area of interest is then re-measured and the volume re-calculated using the second row of scanners 15. An on-board computer can be used to choose the appropriate course of action based on the gathered data, i.e. possibly apply a priming coat, fill the hole or crack with the appropriate material(s), or don't repair and note the damage to a log for further action later. The appropriate interwoven arrays of fast acting pneumatic dispensing nozzles 17 would be activated according to the chosen course of action, dispensing any of a multiplicity of road repair materials. To ensure a smooth finish the suitable Teflon shoed road surface tampers 18 would be activated. The application of a finishing coat/sealer can be applied to the surface, if required by a second row of dispenser 36 as seen in the drawings. A third row of scanners 20 checks the repair and the rapid road repair vehicle 10 performance. Maps of the road's condition using the gathered data are recorded for future analysis and for maintenance records.

The problems addressed by the rapid road repair vehicle 10 are many as can be easily seen by those skilled in this art. The rapid road repair vehicle 10 lessens traffic congestion and the avoidance of road closures during road surface repairs. The rapid road repair vehicle 10 detects and fixes small roadway irregularities early, avoiding their escalation and lowering the cost of repair. The rapid road repair vehicle 10 saves labor and equipment costs. The rapid road repair vehicle 10 saves wear and tear on the components of motor vehicles that deal with "Pot Holes". The rapid road repair vehicle 10 conceivably helps to avoid accidents and saves lives due to poor road conditions. The rapid road repair vehicle 10 conceivably saves lives of road repair workers by not exposing them the hazards of traffic or the potentially harmful chemical substances used to repair such surfaces. The rapid road repair vehicle 10 will find wide spread use anywhere roads or other similar surfaces are presently repaired by a crew of workers in time consuming hand labor they could be repaired by one operator with the minimal skills of a bus/truck driver. The repairs would be accomplished using one piece of equipment which could be operated any time of the day or night. Roads could be fixed much faster, cheaper, and more safely, with little or no disruption to traffic or loss of travelers' time. Road repair is the responsibility of governments large and small all over the world. The recognition part of this system could be installed on any vehicle at any time and would be used to map road conditions which might have military applications as well as civilian. Private industry would be employed to build the many units required. Although the cost of high speed patching material is high, the largest part of the cost of repairing roads is the labor, which would be greatly reduced. The savings in indirect costs would also be considerable, such as avoidance of closing high volume traffic lanes or freeways, less fuel consumption when traffic flows smoothly, less wear and tear on brakes and other parts due to stop-and-go driving, avoids drivers stress, which in turn affects business productivity and mental health.

Thus it will be appreciated by those skilled in the art that the present invention is not restricted to the particular preferred embodiments described with reference to the drawings, and that variations may be made therein without departing from the scope of the present invention as defined in the appended claims and equivalents thereof.

What is claimed is:

1. A rapid road repair vehicle, comprising: a vehicle capable of traveling over a surface to be repaired; a first row of scanners attached to said vehicle capable of detecting and measuring at least one surface imperfection in the surface to be repaired; a row of cleaning devices attached to said vehicle to clean the surface imperfection; a second row of scanners attached to said vehicle for remeasuring the cleaned imperfection and for calculating the volume of the surface imperfection; an array of fast acting pneumatic dispensing nozzles attached to said vehicle, said array comprising a plurality of interwoven and independently addressable nozzles to apply an amount of repair material to the surface imperfection to be repaired; a row of surface tampers attached to said vehicle to smooth the surface of the repaired surface imperfection; a row of dispensing nozzles to apply a finish coat/sealer over the repaired surface imperfection; and a third row of scanners attached to said vehicle to catalog the repair work.

2. A rapid road repair vehicle according to claim 1, wherein said vehicle includes a means for altering the length of said vehicle to accommodate the setting time of the repair material being used and the speed of the vehicle over the surface to be repaired.

3. A rapid road repair vehicle according to claim 1, wherein said first and second row of scanners are high speed laser scanners to enhance the speed with which calculations and repairs can be made.

4. A rapid road repair vehicle according to claim 1, wherein said vehicle has means for altering the width of said vehicle to accommodate the width of the surface to be repaired in one pass over the surface.

5. A rapid road repair vehicle according to claim 1, wherein said means for altering the width is a set of wings on each side of said vehicle and wherein each set of wings contains scanners, cleaning devices, nozzles, and tampers, thereby providing width extensions for the scanners, cleaning devices, nozzles, and tampers to accommodate wider surfaces to be repaired.

6. A rapid road repair vehicle according to claim 1, wherein said vehicle has a display sign on its rear end to warn traffic of the repairs in process.

7. A rapid road repair vehicle according to claim 1, wherein data from said third row of scanners is recorded along with a GPS location and a time to catalog the repair surface history.

8. A rapid road repair vehicle according to claim 1, wherein said cleaning devices include a leading row of air pressure devices and a trailing row of vacuum devices to remove all loose materials from the surface imperfections found in preparation for the repairs to be effected.

* * * * *